United States Patent [19]

Guldager

[11] Patent Number: 4,646,373

[45] Date of Patent: Mar. 3, 1987

[54] CELLULAR ELEMENT

[76] Inventor: Hans Guldager, Rypevang 4, Allerod, Denmark, 3450

[21] Appl. No.: 784,387

[22] Filed: Oct. 4, 1985

[30] Foreign Application Priority Data

Nov. 27, 1984 [DK] Denmark ..... 5610/84

[51] Int. Cl.[4] ..... A47C 27/10

[52] U.S. Cl. ..... 5/455; 128/38; 137/869

[58] Field of Search ..... 128/33, 38; 114/345; 441/41; 297/453, DIG. 3; 5/421, 423, 448–450, 453–458, 468, 469; 137/869; 251/61

[56] References Cited

U.S. PATENT DOCUMENTS

| | | | |
|---|---|---|---|
| 2,391,906 | 1/1946 | Kearney | 114/345 |
| 2,575,240 | 11/1951 | Thompson | 137/885 |
| 2,751,933 | 6/1956 | Urteaga | 137/635 |
| 3,008,465 | 11/1961 | Gal | 128/33 |
| 3,320,750 | 5/1967 | Haise et al. | 405/37 |
| 3,822,425 | 7/1974 | Scales | 5/456 |
| 3,909,858 | 10/1975 | Ducker | 5/455 |
| 4,448,228 | 5/1984 | Hashimoto | 141/114 |
| 4,467,999 | 8/1984 | Ritter | 251/61.1 |
| 4,552,133 | 11/1985 | Kawaguchi | 128/44 |

FOREIGN PATENT DOCUMENTS

| | | | |
|---|---|---|---|
| 401767 | 10/1969 | Australia | 5/456 |
| 1122337 | 1/1962 | Fed. Rep. of Germany | 251/61.1 |
| 1189927 | 10/1959 | France | 5/455 |
| 83676 | 7/1981 | Japan | 251/61 |

OTHER PUBLICATIONS

Michelitsch, "Valve", 10/5/1964, p. 367, *IBM Techical Disclosure Bulletin.*

*Primary Examiner*—John E. Murtagh
*Assistant Examiner*—Andrew Joseph Rudy
*Attorney, Agent, or Firm*—Holman & Stern

[57] ABSTRACT

In a cellular element, e.g. an air mattress, the individual cells (1) are connected via a narrow passage (2) to a duct (3) which can be connected via a valve to a first pressure source. In each cell (1) a body (4) is placed, bearing against the mouth of the passage (2) into the cell, closing it tightly, and in the duct (3) at least one expansible organ (5) is placed which, when expanding, will press the body (4) away from the mouth of the passage (2).

The expansible organ or organs may consist of a tube, which is closed at one end, and the other end of which can be connected to a second pressure source, if required via a valve.

The body (4) placed in a cell (1) may appropriately be hollow and made of a yielding material.

In such an element a wall of each cell, e.g. in the form of a membrane, can make up an individual supporting surface. When the cells are exposed to uneven pressure from outside, e.g. because a person is sitting on the element, and the bodies placed in the cells are pressed away from the position where the passage between cells and duct is closed, the medium held in the cells—e.g. air—will be able to circulate freely among the cells, and the cells will assume shapes corresponding to the external pressure. When the pressure of the expansible organ on the bodies ceases, the bodies will again close the passages between cells and duct, and the compound supporting surface has been individually adjusted.

3 Claims, 1 Drawing Figure

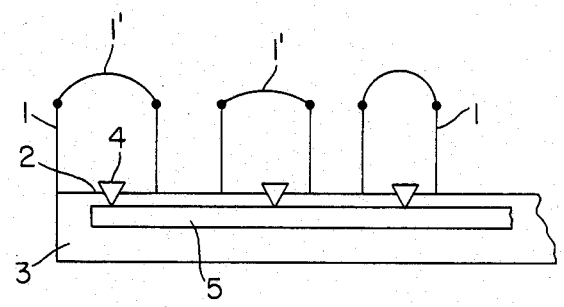
1'
1'
1
1
4
2
3
5

CELLULAR ELEMENT

The present invention concerns a cellular element, e.g. an air mattress, in which the individual cells are connected via a narrow passage to a duct, which can be connected via a valve to a first pressure source.

It is important, especially in the case of prolonged confinement to bed, that the actions of the support on the patient are varied. This will contribute to the prevention of pressure sores. For this reason it is possible to have pads which are composed of a large number of supporting surfaces, which may be raised or lowered individually, so that the individual supporting surface does not press constantly against the patient. Such a pad is mechanically complicated and therefore comparatively expensive. It should be noted that pads of the above-mentioned kind are used also as seats in e.g. wheel chairs.

It might be possible to provide the seats and backs of drivers' seats in cars with a similar system of individually adjustable supporting surfaces in order to allow individual adaptation to successive drivers.

According to the present invention it is suggested in the case of a cellular element of the kind mentioned at the beginning that in each cell a body should be placed in such a way that the body bears against the mouth of the passage into the cell, thus closing it tightly, and that in the duct at least one expansible organ should be placed which, when expanding, will press the body away from the mouth of the passage.

In a cellular element thus shaped a wall in each cell, e.g. in the form of a membrane, can make up the above-mentioned individual supporting surface. When the cells are exposed to diverse pressures from outside, e.g. because a person is sitting on the element, and the bodies placed in the cells are pressed out of the position in which they close the passage between the cells and the duct, the medium held in the cells—e.g. air—will be able to circulate freely among the cells, and the cells will assume shapes corresponding to the external pressures. When the pressure of the expansible organ on the bodies ceases, the bodies will again close the passages between the cells and the duct, and thus the compound supporting surface has been individually adjusted.

By dividing the cells into mutually independent groups and assigning an expansible organ to each group it is possible to obtain in a simple way a mattress where the pressure of the individual supporting surfaces can be varied by hand or governed by a suitable programmable unit.

It is appropriate if the expansible organ/organs consists/consist of a tube, which is closed at one end, and the other end of which can be connected to a second pressure source, if required by means of a valve.

It is appropriate according to the invention that the body placed in a cell is hollow and made of a yielding material. Hereby increased certainty of tight closing of the passage between cell and duct is obtained because the body yields to pressure in the cell.

BRIEF DESCRIPTION OF THE DRAWINGS

In the following the invention will be described in more detail in connection with the drawing, which shows schematically a cellular element, where the individual cells 1 are connected via a narrow passage 2 to a duct 3. The duct can be connected via a valve, which is not shown in the drawing, to a first pressure source.

DESCRIPTION OF THE PREFERRED EMBODIMENT

In each cell 1 a body 4 is placed, bearing against the mouth of the passage into the cell, thus closing it tightly. In the duct 3 an expansible organ is placed. This expansible organ is in the form of a tube 5, which is closed at one end, and the other end of which can be connected to a second pressure source via a valve, which is not shown in the drawing.

In the version shown here the bodies 4 are fixed in such a way that elastic force keeps them in such a position that they close the passage 2, until an increased pressure in the expansible organ 5 makes this organ expand and press the bodies 4 away from the closing position. (The way in which the bodies are fixed is not shown in the drawing.) Hereby the interconnection between the cells 1 is opened, so that the cells can adapt themselves according to the pressure from outside against e.g. a yielding cell wall 1'. When the interconnection between the cells is broken because the pressure in the tube 5 is released, the cells will keep their shape until the passages 2 are opened again.

I claim:

1. An inflatable cellular structure comprising individual inflation cells each formed at least partially of a flexible material and each connected to an inflation duct through an inlet-outlet passage, and valve means for the respective inlet-outlet passages comprising a valve body in each cell extending through the respective inlet-outlet passage and an expansion element in said duct connected to the valve body for moving the valve body between respective positions in which the valve body opens and closes the inlet-outlet passage responsive respectively to expanding and contracting movements of the element.

2. The invention as defined in claim 1 wherein the expansion element is an inflatable tube for moving the respective valve bodies into the respective cells away from the respective passages when the tube is inflated thereby opening the respective passages, and for moving the respective valve bodies into obturating position in the respective passages when the tube is deflated.

3. The invention as defined in claim 1 wherein the respective valve bodies are each made of a hollow yieldable material.

* * * * *